US006944418B2

(12) United States Patent
Tamaoki

(10) Patent No.: US 6,944,418 B2
(45) Date of Patent: Sep. 13, 2005

(54) IMAGE FORMING APPARATUS

(75) Inventor: Tomohiro Tamaoki, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 70 days.

(21) Appl. No.: 10/694,862

(22) Filed: Oct. 29, 2003

(65) Prior Publication Data

US 2004/0091291 A1 May 13, 2004

(30) Foreign Application Priority Data

Oct. 31, 2002 (JP) ..... 2002-318873

(51) Int. Cl.[7] ..... G03G 15/01; G03G 15/16
(52) U.S. Cl. ..... 399/297; 399/296; 399/302
(58) Field of Search ..... 399/2, 3, 4, 296, 399/297, 298, 301–302, 366; 430/47, 126; 358/526, 530

(56) References Cited

U.S. PATENT DOCUMENTS 6,091,922 A 7/2000 Bisaiji ..... 399/297
6,434,354 B2 * 8/2002 Bisaiji ..... 399/296

FOREIGN PATENT DOCUMENTS

JP 11-52758 2/1999

* cited by examiner

*Primary Examiner*—Hoang Ngo
(74) *Attorney, Agent, or Firm*—Fitzpatrick, Cella, Harper & Scinto

(57) ABSTRACT

Provided is an image forming apparatus, including: a movable image bearing body; an image forming unit for forming a developer image on the image bearing body; a transferring unit for transferring the developer image formed on the image bearing body onto a moving transferring medium; and a control unit for controlling the image forming unit to form a predetermined image composed of a dot image with a predetermined density prior to formation of a normal image, in which a composite image is formed from the normal image and the predetermined image in an area where the normal image is to be formed, and the dot image is formed in a dot area having the normal image and the predetermined image overlapped with each other, with a density determined on the basis of a relationship between a density of the normal image and the predetermined density in the dot area.

13 Claims, 12 Drawing Sheets

PWM TABLE T0

PWM TABLE T1

IMAGE FORMING APPARATUS

BACKGROUND OF THE INVENTION

1. Field of the Invention

The present invention relates in general to an image forming apparatus adopting an electrostatic system, an electrophotographic recording system, or the like. In particular, the present invention relates to an image forming apparatus for forming an image such as a dot pattern other than a normal image on an image bearing body in order to prevent an image defect when a developer image on an image bearing body is transferred onto a transferring medium such as an intermediate transferring body or a transferring material.

2. Related Background Art

Heretofore, there has been used an image forming apparatus having a plurality of image forming units as recording units in each of which a laser beam or a light emitted from a light emitting element such as an LED which is light-modulated in accordance with external information is applied to an image bearing body such as a photosensitive drum having a surface charged with electricity corresponding to a predetermined potential to change the potential of a portion irradiated with the light to thereby form an electrostatic latent image, the electrostatic latent image on the photosensitive drum is developed, and a developer image (toner image) is transferred onto a transferring medium such as a transferring material or an intermediate transferring body conveyed by a transferring material conveying body. Regarding such image forming apparatus, there has been proposed an image forming apparatus capable of forming a color image by utilizing a method in which: respective image forming units form images having different colors, and the images are transferred onto the transferring materials one on the other while transferring materials are successively conveyed to the recording units; or after the images are transferred onto an intermediate transferring body one on the other, the images are collectively transferred onto a transferring material.

Here, a primary transfer system in which an image is transferred from a photosensitive drum to a belt-like intermediate transferring body (intermediate transferring belt) will be described as an example. In an image forming apparatus of this sort, it is conceivable that in particular, for the purpose of enhancing a primary transfer latitude, a primary transfer current is optimally set. However, when the primary transfer current is low, transfer deficiency is caused, while retransfer is caused when the primary transfer current is high.

For this reason, for the purpose of realizing the enhancement of the primary transfer latitude, a method including providing a difference in peripheral speed between each of the photosensitive drums and the intermediate transfer belt, is suitably implemented. This provision of the difference in peripheral speed results in that in particular, a central portion of a fine line of a secondary color is not omitted to realize enhancement of the transfer latitude. However, a frictional force is usually generated between each of the photosensitive drums and the intermediate transferring belt due to the difference in peripheral speed.

A coefficient of friction is changed between a case where there is developer (toner) between each of the photosensitive drums and the intermediate transferring belt and a case where there is no developer between each of the photosensitive drums and the intermediate transferring belt due to the frictional force generated between each of the photosensitive drums and the intermediate transferring belt, so that a rotational speed of each of the photosensitive drums fluctuates. This results in that image exposure to the photosensitive drums is blurred and thus an image streak is generated.

This phenomenon also occurs in a transfer system for transferring a toner image onto a transferring material conveyed from the photosensitive drums to the transferring material conveying body. In this case, the transferring material conveying body and the intermediate transferring body are collectively referred to as a transfer/movement unit.

A problem is described in Japanese Patent Application Laid-open No. H11-52758 (or U.S. Pat. No. 6,091,922) that with a construction in which no difference in peripheral speed is provided between an image bearing body and a transfer/movement unit, a non-intentional speed difference is generated due to decentering or the like of a drive roller, and as a result, color drift is generated. Further, in Japanese Patent Application Laid-open No. H11-52758 (or U.S. Pat. No. 6,091,922), there is described a construction in order to solve this problem. That is, dot toner images are dispersedly formed in the form of predetermined minute dots so as to overlap a normal image, so that an image is more stably formed to allow an image of high quality to be printed.

However, in many cases, such a dot pattern is formed so as to overlap a toner image as a normal image, which is intentionally formed by a user based on external information. Thus, there arises a first problem in that if each dot toner image is formed in a state of laser full lighting using the above-mentioned image forming apparatus when a predetermined dot pattern is formed, even when a dot toner image is formed with yellow toner so as to be made inconspicuous, the dot toner image formed with yellow toner becomes conspicuous in a portion (white background portion) to which no toner is transferred in the toner image formed on the basis of the external information.

Further, there arises a second problem in that when conversely, a dot pattern is formed not in a state of the laser full lighting, but in a half tone state, since a color of the dot pattern appears to be missing in a set-solid portion in the toner image formed on the basis of the external information, a normal image appears to be rough to reduce quality of image.

Moreover, generation of an image streak due to a change in frictional force is not limited to only a case of the formation of a color image as a normal image. Thus, for example, in a case where an image of black (K) monochrome is formed as a normal image by a color copying machine, or even in a case where an image is formed by a monochrome copying machine, a light and shade image streaks appear due to a change in frictional force. For this reason, in formation of an image of black monochrome as well as in formation of an image by the monochrome copying machine, there is a need to form a dot pattern with black toner. However, when a dot pattern is formed with black toner, for both the above-mentioned first and second problems, the disadvantages such as the conspicuousness and the roughness of the dot pattern are emphasized as compared with a case where a dot pattern is formed with yellow toner. As a result, the reduction of image quality becomes a serious problem.

SUMMARY OF THE INVENTION

In the light of the foregoing, it is, therefore, an object of the present invention to provide an image forming apparatus which is capable of suppressing conspicuousness of a dot image formed so as to overlap a normal image, and roughness resulting from the conspicuousness to satisfactorily form an image in an image forming apparatus for forming a dot image other than a normal image.

In order to attain the above-mentioned object, a preferable image forming apparatus according to the present invention includes:

a movable image bearing body;

image forming means for forming a developer image on the image bearing body;

transferring means for transferring the developer image formed on the image bearing body onto a moving transferring medium; and control means for controlling the image forming means to form a predetermined image composed of dot images with a predetermined density prior to formation of a normal image, wherein the control means controls the image forming means so as to:

form a composite image from the normal image and the predetermined image in an area where the normal image is to be formed; and form the dot images in a dot area having the normal image and the predetermined image overlapped with each other, with a density determined on the basis of a relationship between a density of the normal image and the predetermined density in the dot area.

DESCRIPTION OF THE PREFERRED EMBODIMENTS

An image forming apparatus according to the present invention will hereinafter be described in more detail with reference to the accompanying drawings.

First Embodiment

An image forming apparatus according to a first embodiment of the present invention will hereinbelow be described in more detail with reference to the accompanying drawings.

Figure 10:
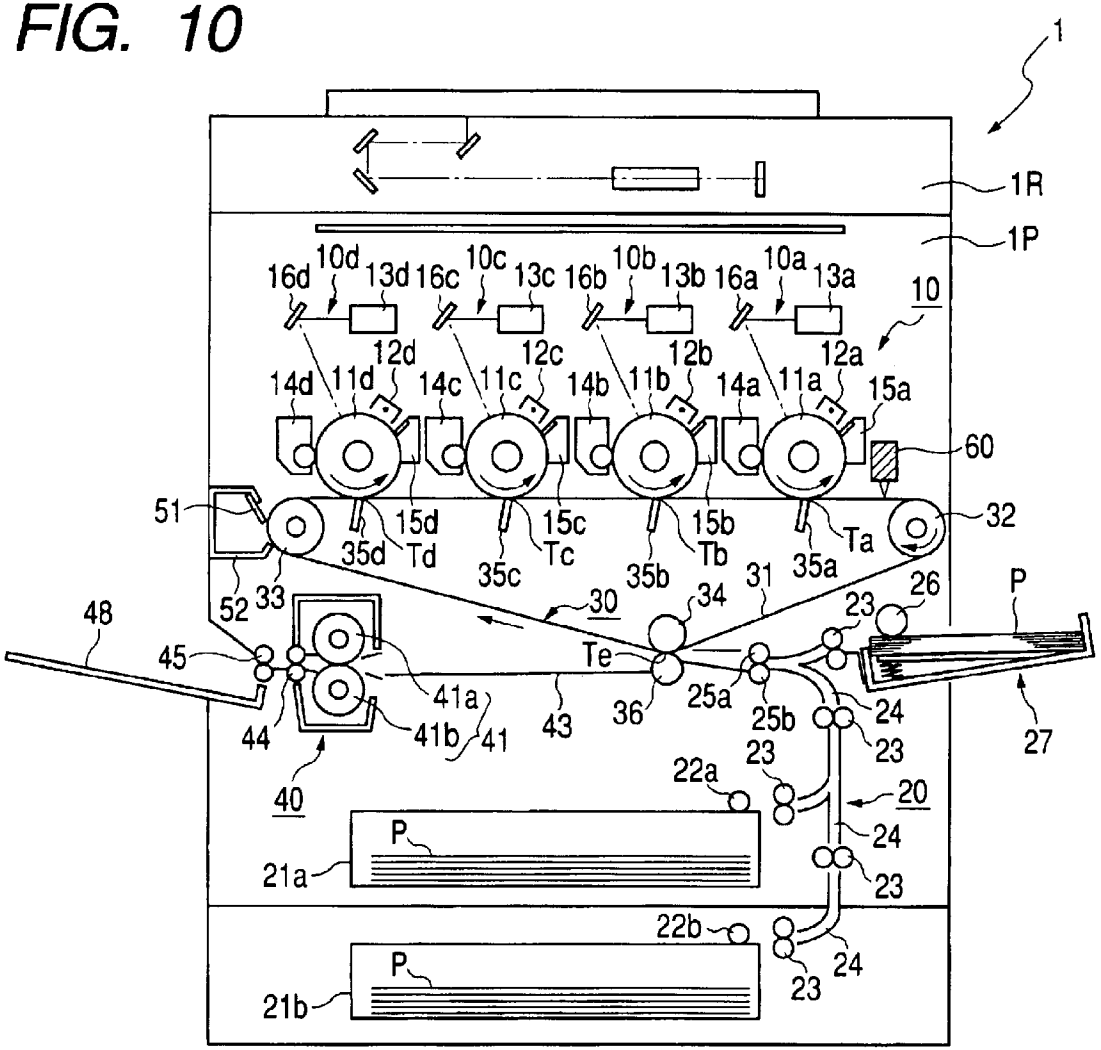
FIG. 10 is a schematic constructional view showing an example of an image forming apparatus according to the present invention.

FIG. 10 is a cross sectional view of a main portion of an image forming apparatus in which the present invention is implemented. The image forming apparatus of this embodiment is described as a color image outputting apparatus 1 in which an electrophotographic system is adopted. In formation of a normal image, an image of an original as external information is read out in an optical system 1R. In an image output unit 1P, the image obtained from the external information from the optical system 1R is formed on a transferring material P. Moreover, a plurality of image forming units 10 for each of which the present invention is judged to be especially effective are arranged in parallel in the image output unit 1P. In addition, an intermediate transfer system is adopted.

Figure 11:
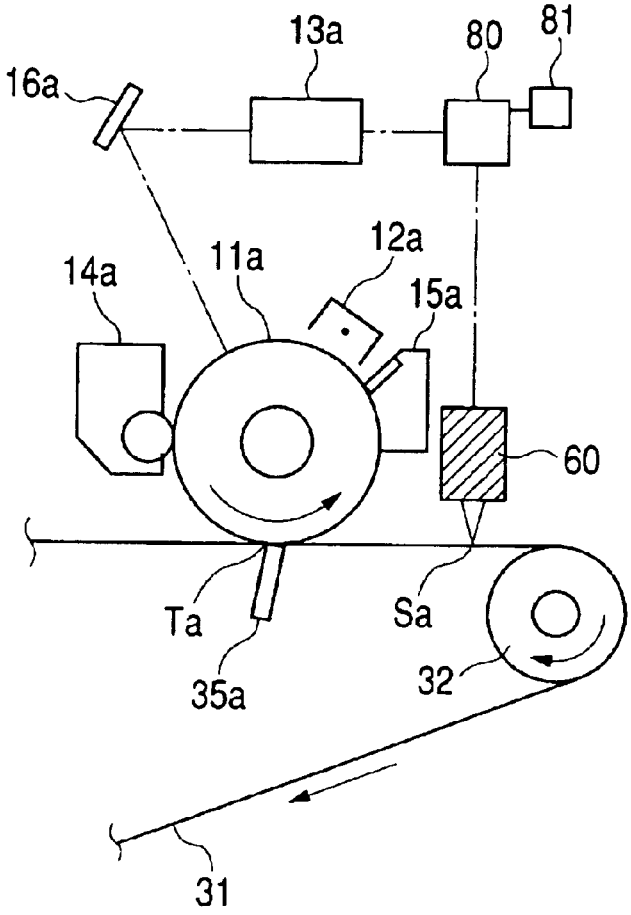
FIG. 11 is a schematic constructional view showing an example of a mechanism for detecting color drift.

The image output unit 1P is roughly composed of an image forming unit 10 in which four stations 10*a*, 10*b*, 10*c*, and 10*d* having the same construction are provided in parallel, a sheet feeding unit 20, an intermediate transferring unit 30, a fixing unit 40, and a control unit 80 (refer to FIG. 11).

Moreover, the individual units will now be described in detail. The image forming unit 10 has a construction as will be described below. In the stations 10*a*, 10*b*, 10*c*, and 10*d*, photosensitive drums 11*a*, 11*b*, 11*c*, and 11*d* as image bearing bodies are rotatably supported with their centers and adapted to be driven and rotated in a direction indicated by arrows, respectively. Primary chargers 12*a*, 12*b*, 12*c*, and 12*d*, exposing units 13*a*, 13*b*, 13*c*, and 13*d* of an optical system serving as an exposure unit, folding mirrors 16*a*, 16*b*, 16*c*, and 16*d*, and developing units 14*a*, 14*b*, 14*c*, and 14*d* are arranged so as to confront outer peripheral surfaces of the photosensitive drums 11*a*, 11*b*, 11*c*, and 11*d* along the direction of rotation, respectively.

In the primary chargers 12*a* to 12*d*, surfaces of the photosensitive drums 11*a* to 11*d* are given charges having a uniform charge amount. Next, in the exposing units 13*a* to 13*d*, light beams such as laser beams which are modulated in accordance with a recording image signal are applied onto the photosensitive drums 11*a* to 11*d* through the folding mirrors 16*a* to 16*d* to expose the photosensitive drums 11*a* to 11*d* to thereby form electrostatic latent images on the photosensitive drums 11*a* to 11*d*, respectively.

Moreover, the above-mentioned electrostatic latent images are visualized by the developing units 14*d*, 14*c*, 14*b*, and 14*a* in which developers of four colors composed of yellow, cyan, magenta, and black (hereinafter referred to as "toner" for short when applicable) are accommodated, respectively. Then, developer images (toner images) as visible images obtained through visualizing process are transferred onto an intermediate transferring belt 31 as an intermediate transferring body serving as a transferring medium in primary transferring portions Ta, Tb, Tc, and Td, respectively.

On downstream sides where the photosensitive drums 11*d* to 11*a* are rotated to pass through the primary transferring portions Td to Ta, the residual toner which is not transferred onto the intermediate transferring belt 31, but is left on the photosensitive drums 11*d* to 11*a* is removed by cleaning units 15*d*, 15*c*, 15*b*, and 15*a* to clean the surfaces of the photosensitive drums 11*d* to 11*a*, respectively.

The images are successively formed with the four kinds of toners through the above-mentioned process.

The sheet feeding unit 20 is composed of cassettes 21*a* and 21*b* for accommodating therein transferring materials P, a manual feed tray 27, pick-up rollers 22*a*, 22*b*, and 26 for feeding the transferring materials P sheet by sheet from the cassettes 21*a* and 21*b* or from the manual feed tray 27, sheet feeding roller pairs 23 and a sheet feeding guide 24 for conveying the transferring materials fed from the pick-up roller 22*a*, 22*b*, or 26 to registration rollers 25*a* and 25*b*, and the registration rollers 25*a* and 25*b* for feeding the transferring materials P to a secondary transferring area Te at the same timing as formation of images in the image forming unit.

The intermediate transferring unit 30 will hereinbelow be described in detail. The intermediate transferring belt 31 serving as the transferring medium is wound around a drive roller 32 for transmitting a driving force to the intermediate transferring belt 31, a driven roller 33 for being driven so as to follow the rotation of the intermediate transferring belt 31, and a secondary transferring confronting roller 34 provided so as to face the secondary transferring area Te through the intermediate transferring belt 31. The drive roller 32, the driven roller 33 and the secondary transferring confronting roller 34 are winding rollers. A primary transferring plane is defined between the drive roller 32 and the driven roller 33 of these rollers.

The drive roller 32 is constructed by coating a surface of a metallic roller with rubber (urethane or chloroprene) with several millimeters thickness in order to prevent the drive roller 32 from slipping on the intermediate transferring belt 31. The drive roller 32 is driven and rotated in a direction indicated by an arrow by a pulse motor (not shown).

The primary transferring plane confronts the image forming units 10*a* to 10*d*. In a space defined between the primary transferring plane and the image forming units 10*a* to 10*d*, the photosensitive drums 11*a* to 11*d* confront a primary transferring surface T of the intermediate transferring belt 31. Thus, the primary transferring portions Ta to Td are located on the primary transferring surface T.

In the primary transferring portions Ta to Td which each of the photosensitive drums 11*a* to 11*d*, and the intermediate transferring belt 31 confront, chargers 35*a*, 35*b*, 35*c*, and 35*d* for primary transfer are arranged so as to contact a rear face of the intermediate transferring belt 31. In addition, a secondary transferring roller 36 is arranged so as to confront the secondary transferring confronting roller 34. Then, a secondary transferring area Te is formed by a nip portion defined on the intermediate transferring belt 31. The secondary transferring roller 36 is pressed against the intermediate transferring belt 31 under a suitable pressure.

In addition, a cleaning blade 51 for cleaning an image formation surface of the intermediate transferring belt 31, and a waste toner box 52 for accommodating therein waste toner are provided on a downstream side of the secondary transferring area Te on the intermediate transferring belt 31.

The fixing unit 40 is composed of a fixing roller 41*a* including a heat source such as a halogen heater in its inside and a roller 41*b* pressed by the fixing roller 41*a* (the roller 41*b* may also include a heat source in some cases), a guide 43 for guiding the transferring material P to a nip portion of the above-mentioned roller pair 41, an inner sheet discharging roller 44 and an outer sheet discharging roller 45 for further guiding the transferring material P discharged through the roller pair 41 to the outside of the image forming apparatus, and the like.

The control unit 80 is composed of a CPU (not shown) for controlling the operations of the mechanisms within the above-mentioned units, a control substrate (not shown), a motor drive substrate (not shown) and the like. Upon issue of an image formation operation start signal from the control unit 80, the transferring materials P are started to be fed from a sheet feeding stage selected depending on a selected paper size and the like.

Next, a description will hereinbelow be given on the basis of the operation of the image forming apparatus 1.

Upon issue of the image formation operation start signal from the control unit 80, first of all, the transferring materials P are fed sheet by sheet from the cassette 21*a* or 21*b*, or the manual feed tray 27 by the pick-up roller 22*a* or 22*b*, or 26. Then, the transferring material P is guided through the sheet feeding guide 24 by the corresponding one of the sheet feeding roller pairs 23 to be conveyed to the registration rollers 25*a* and 25*b*. At this time, the registration rollers 25*a* and 25*b* are stopped, and hence a leading end of the transferring material P is brought into contact with the nip portion of the registration rollers 25*a* and 25*b*. Thereafter, the registration rollers 25*a* and 25*b* start to be rotated at in accordance with the timing when the image forming units 10*a* to 10*d* start to form images, respectively. The timing of the rotation of the registration rollers 25*a* and 25*b* is set such that the transferring material P, and the developer images (toner images) primarily transferred onto the intermediate transferring belt 31 by the image forming unit 10 just meet in the secondary transferring area Te.

On the other hand, in the image forming unit 10, upon issue of the image formation operation start signal from the control unit 80, the toner image formed on the photosensitive drum 11*d* located in the most upstream side in a rotating direction of the intermediate transferring belt 31 is primarily transferred onto the intermediate transferring belt 31 in the primary transferring area Td by the charger 35*d* for primary transfer to which a high voltage is applied through the above-mentioned process.

The primarily transferred toner image is carried up to the next primary transferring area Tc. In the primary transferring area Tc, the image formation is carried out after a time delay by a period of time required for the toner image to be carried to the primary transferring area Tc, and the next image is transferred in a state where the registration (image position) is adjusted onto the first image. The same process is repeatedly carried out for the primary transferring areas Ta and Tb of other colors, and finally, the toner images of the four colors are primarily transferred onto the intermediate transferring belt 31 in an overlapped manner.

Thereafter, when the transferring material P enters the secondary transferring area Te and comes into contact with the intermediate transferring belt 31, a high voltage is applied to the secondary transferring roller 36 at the same timing as the passing of the transferring material P. Then, overlapped toner images of the four colors formed on the intermediate transferring belt 31 through the above-mentioned process are collectively transferred onto the surface of the transferring material P. Thereafter, the transferring material P is accurately guided to the nip portion of the fixing roller pair 41 by an conveyance guide 43. Then, the toner images are fixed to the surface of the transferring material P with the heat of the fixing roller pair 41 and the pressure at the nip portion. Thereafter, the resultant sheet is conveyed by the inner and outer sheet discharging roller pairs 44 and 45 to be discharged to the outside 48 of the image forming apparatus 1.

A registration sensor 60 for detecting misregistration is provided for the purpose of correcting deviation of registration of the color images formed on the respective photosensitive drums 11*a* to 11*d*, i.e., the color drift (misregistration) due to the mechanical mounting error appearing among the photosensitive drums 11*a* to 11*d*, the optical path length errors and the optical path changes in the laser beams generated through the respective exposing units 13*a* to 13*d*, the warpage caused by the environmental temperature of the LED, and the like. The registration sensor 60 is located in a position on the transferring area on the downstream side of the whole image forming unit 10 and before the drive roller 32 that folds the intermediate transferring belt 31. When color drift occurs due to a change in rotational speed of each of the photosensitive drums 11*a* to 11*d* resulting from a difference in speed between the intermediate transferring belt 31 and each of the photosensitive drums 11*a* to 11*d*, the color drift is detected by the registration sensor 60.

FIG. 11 is a schematic view in the vicinity of the registration sensor 60 (including an LED as a light emitting body, and a photodiode as a light receiving body) as a color drift detecting unit for detecting patterns for registration correction (images for color drift detection).

The pattern images for registration correction (images for color drift detection) which are formed from the photosensitive drums 11*a* to 11*d* onto the intermediate transferring belt 31 in accordance with a signal outputted from a unit 81 for generating patterns for registration correction in the control unit 80 are read by the registration sensor (detection unit) 60 as a color drift detecting unit composed of the light emitting element and the light receiving element to detect the misregistration on the photosensitive drums 11*a* to 11*d* corresponding to the four colors. Then, an image signal to be recorded is electrically corrected, or the folding mirrors 16*a* to 16*d* provided in the optical paths of the laser beams are driven by a color drift correcting unit included in the control unit 80 to thereby correct a change in the optical path length or a change in optical path.

The intermediate transferring belt 31 is an endless belt made of an elastic body containing rubber, elastomer, or the like as a raw material, and has Young's modulus of equal to or larger than $10^7$ Pa in a circumferential direction. A thickness of the intermediate transferring belt 31 is desirably in the range of 0.3 to 3.0 mm from a viewpoint of ensuring thickness accuracy and strength and of realizing a flexible rotary motion. Moreover, a resistivity of the intermediate transferring belt 31 is adjusted to a desired value (a volume resistivity is desirably equal to or lower than $10^{11}$ Ωcm) by adding electroconductive agent such as metallic powder (e.g., carbon powder).

In addition, in this embodiment, for the purpose of increasing the primary transferring latitude, a peripheral speed difference is set such that a travel speed of the intermediate transferring belt 31 is higher than a rotational speed of each of the photosensitive drums 11*d* to 11*a* by several percentages.

In the image forming apparatus in which the peripheral speed difference is set between each of the image bearing bodies and the intermediate transferring body, before a normal image is formed on the basis of external information obtained by reading an original with the optical system 1R through the above-mentioned process, a predetermined image is formed onto the intermediate transferring belt.

Normally, in a case where there is a peripheral speed difference between each of the photosensitive drums 11*a* to 11*d* and the intermediate transferring belt 31, a frictional force is generated between each of the photosensitive drums 11*a* to 11*d* and the intermediate transferring belt 31. Then, the frictional force is changed between a case where there is toner between each of the photosensitive drums 11*a* to 11*d* and the intermediate transferring belt 31 and a case where there is no toner between each of the photosensitive drums 11*a* to 11*d* and the intermediate transferring belt 31. As a result, the rotational speed of each of the photosensitive drums 11*a* to 11*d* fluctuates so that the image exposure to each of the photosensitive drums 11*a* to 11*d* is blurred to generate an image streak in an image leading end portion.

The generation of the image streak in the image leading end portion means that the rotational speed of each of the photosensitive drums 11*a* to 11*d* fluctuates in a position where image transfer begins when an area is changed from a non-image area to an image area (i.e., a state is abruptly changed from a state where there is no toner to a state where there is toner) in the transferring portions Ta to Td defined between the photosensitive drums 11*a* to 11*d* and the transferring belt 31 to thereby readily blur the image.

Then, before the toner images formed on the photosensitive drums 11*a* to 11*d* are transferred, a predetermined image is previously formed between the transferring belt 31 and each of the photosensitive drums 11*a* to 11*d*, respectively, in order to avoid a situation where from a time point when a sheet area (transferring material area) has entered each of the transferring portions Ta to Td, a state is abruptly changed from a state where there is no toner to a state where there is toner since entrance into the image areas is made because the toner is present between the transferring belt 31 and each of the photosensitive drums 11*a* to 11*d*. Accordingly, it is possible to relax the fluctuation in the rotational speed of each of the photosensitive drums 11*a* to 11*d*. As a result, the stable image formation is carried out.

In the present invention, the predetermined image is formed in the form of a dot dispersion image (hereinafter referred to as "a dot pattern" when applicable) in which toner images (hereinafter referred to as "dot developer images each having a minute area in units of one or plurality of dots (dot toner images)" when applicable) such that no dot is marked in a fixed main scan position. This is because if a dot is usually dotted in the fixed main scan position, then there is encountered a problem such that longitudinal streak dirt is generated on the secondary transferring roller 36, the toner collects in a specific position of the cleaning blade 51, or the dot toner images transferred onto the transferring material P are conspicuous.

Note that, in this case, a direction along which the drums are scanned with the respective laser beams, i.e., a direction crossing a travel direction of the intermediate transferring belt 31 is referred to as a main scan direction, and a direction along which the photosensitive drums 11*a* to 11*d*, and the transferring belt 31 are moved is referred to as a sub-scan direction.

In order to prevent a change in coefficient of friction between the intermediate transferring belt 31 and each of the photosensitive drums 11*a* to 11*d* which is generated depending on presence or absence of the toner between the intermediate transferring belt 31 and each of the photosensitive drums 11*a* to 11*d*, it is necessary to form the dot pattern before the formation of the normal image. However, in this embodiment, the dot pattern is continuously formed from a time point before the formation of the normal image to a time point at completion of the formation of the normal image.

Figure 2:
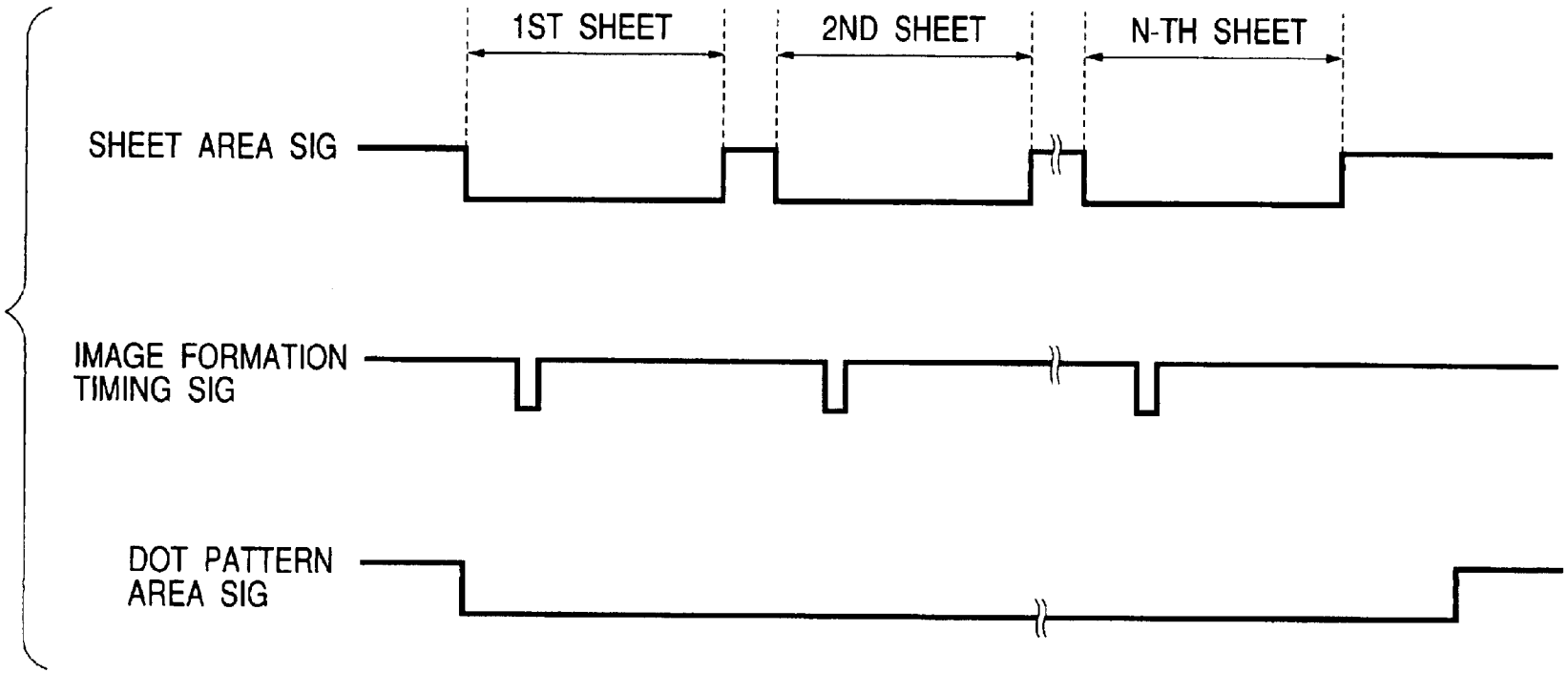
FIG. 2 is a timing chart showing an example of a timing at which a dot dispersion image is formed according to the present invention.

FIG. 2 is a timing chart regarding formation of the dot pattern in this embodiment. In the figure, "a sheet area signal" means a sheet area (transferring material area) signal in the sub-scan direction corresponding to a sheet size of the transferring material P, and "an image formation timing signal" means a timing signal with which the formation of the normal image is actually started. Also, "a dot pattern area signal" means an image area signal with which the dot pattern of the present invention is formed on the intermediate transferring belt 31. Then, as shown in the figure, the formation of the predetermined dot pattern is started before the formation of the normal image.

Moreover, in this embodiment, when N sheets of transferring materials P are continuously printed, the dot pattern is continuously formed for a period of time ranging from the image area start timing for the first sheet to the image area end timing for the N-th sheet. Also, a composite image is formed from the dot pattern and the normal print image for a period of time for the normal print image area.

Figure 3:
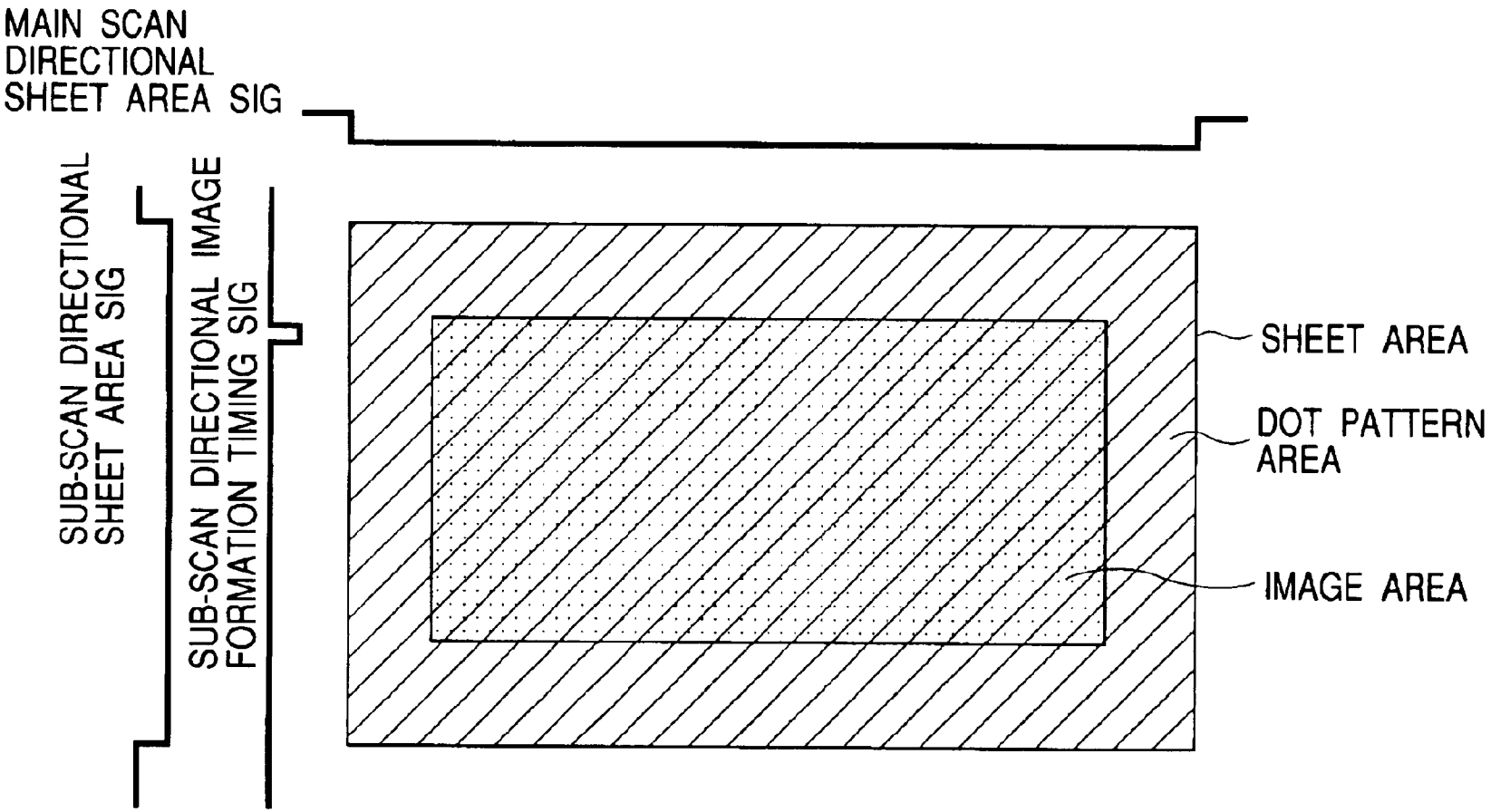
FIG. 3 is a front view showing an example of a dot dispersion image and a normal image area according to the present invention.

FIG. 3 shows the normal image area and the dot pattern area which are formed at such timings on the intermediate transferring belt 31.

The whole area of a sheet area (transferring material area) including an area which is indicated by slant lines and which is located outside the normal image area shows a dot pattern area, and an image of the dot pattern is an image drawn with slant lines in the figure.

An area drawn with dots inside the dot pattern area shows a normal image area, and also shows an area where an image is formed in accordance with a sub-scan directional image formation timing signal. Here, the dot pattern is formed so as to overlap the normal image in the normal image area.

This results in that a gap disappears between the normal image area and the dot pattern area on the upstream side in the travel direction of the intermediate transferring belt 31 having the normal image formed therein. Hence, it is possible to avoid a fluctuation in a coefficient of friction due to a change of a position from a portion having no toner in each of the transferring nips Ta to Td to a portion having the toner.

With respect to the dot pattern in the immediately upstream portion of the normal image area in the travel direction of the intermediate transferring belt 31, it is preferable that as described above, there is no gap between the normal image area and the dot pattern area. However, even when the dot toner images are formed at a timing other than the timing shown in FIG. 2, if the dot toner images are present within the transferring material area, then the toner is present between the intermediate transferring belt 31 and each of the photosensitive drums 11*a* to 11*d* before transferring the normal print image. Hence, it is possible to reduce a change in coefficient of friction generated between the intermediate transferring belt 31 and each of the photosensitive drums 11*a* to 11*d*. In addition, a portion of the dot pattern which is formed within the transferring material area other than the normal image formation area is adapted not to be transferred onto the transferring material P by adjusting the operation timing of the secondary transferring roller 36.

In addition, in this embodiment, in the station 10*d* on the most upstream side of the primary transferring plane T, yellow toner is accommodated in the developing unit 14*b* and thus the station 10*d* is assigned a Y station for forming a yellow toner image. Then, in the Y station, minute dot toner images are formed so as to overlap the image of yellow (Y). Other stations 10*a*, 10*b* and 10*c* are assigned K, C and M stations, respectively, and black (K) toner, cyan (C) toner, and magenta (M) toner are accommodated in the developing units 14*a*, 14*b* and 14*c*, respectively. Then, in these K, C and M stations, the toner images of black, cyan and magenta are formed, respectively. Thus, there is an advantage such that the dot toner images are added to the image in the most upstream station, whereby the dot toner images function to relax a fluctuation of the frictional force in the temporary transferring in all the downstream stations. In addition, if the dots concerned are yellow dots, then it is advantageous because the yellow dots are hardly conspicuous after being transferred onto the transferring material P as compared with M, C, and K dots.

A method for forming a dot pattern will hereinbelow be described.

Figure 4:
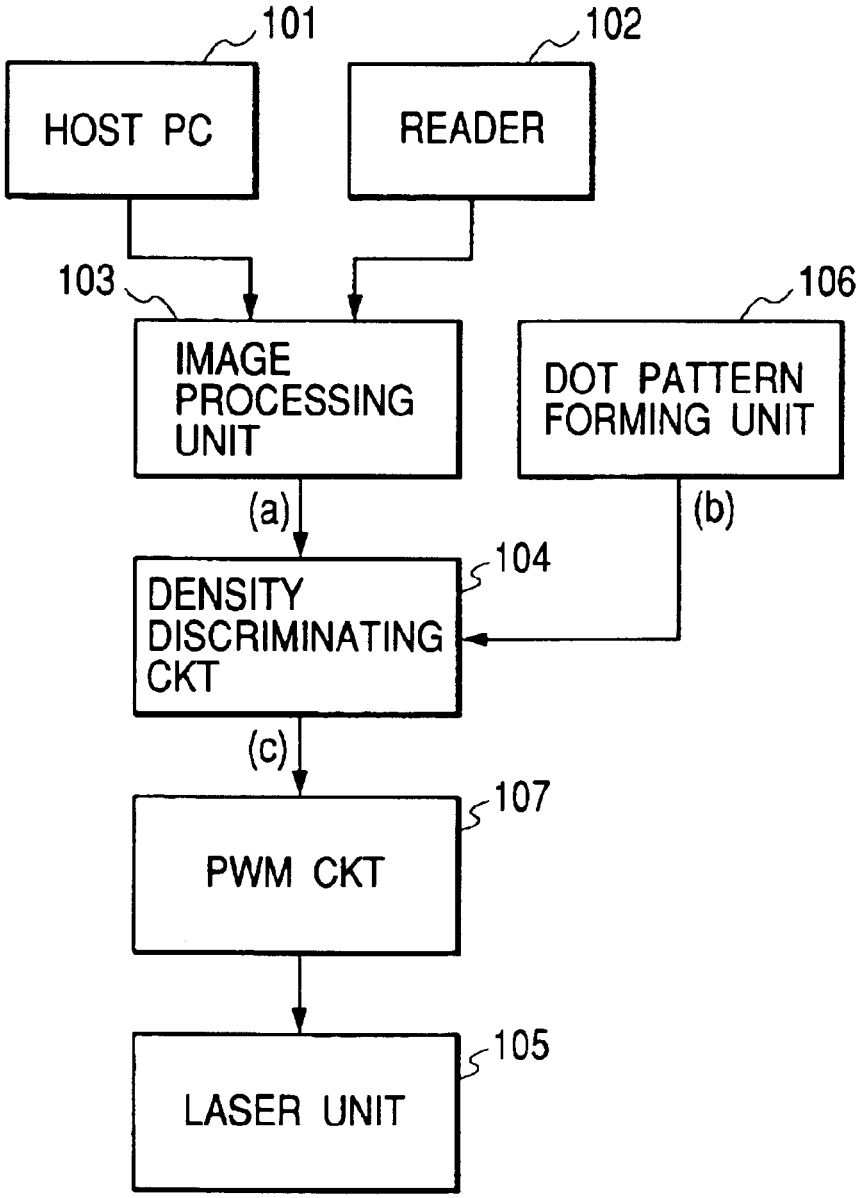
FIG. 4 is a block diagram showing an example of a control circuit for determining density of a dot developer image according to the present invention.

The image data to be inputted to the exposing unit 13*d* is generated in accordance with a block diagram shown in FIG. 4.

The external information for forming the normal image inputted from a host PC 101 or a reader (image reading unit) 102 within the control unit 80 is processed in an image processing unit 103 to be outputted in the form of a normal image signal (a') with which a laser unit 105 acting on the exposing units 13*a* to 13*d* is driven. In addition, in a dot pattern forming unit 106, a dot pattern signal (b) with which the dot pattern having minute dot toner images dispersed therein is formed is generated.

Figure 9A:
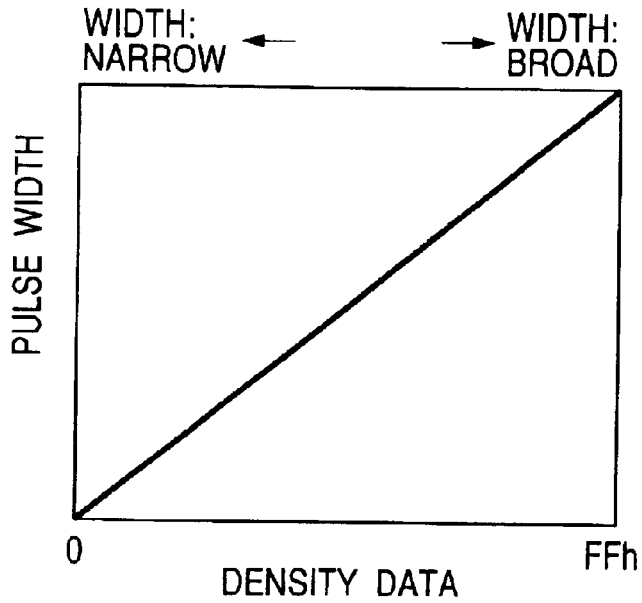
FIGS. 9A and 9B are respectively diagrams of PWM tables each showing a relationship between a pulse width and density data used in another example of a control circuit for determining density of a dot developer image according to the present invention.

While a processing in a density discriminating circuit 104 will be described in detail later, a normal image density value A based on image density information (a) contained in the normal image signal (a') is directly sent, or a predetermined density value B defined for the dot pattern is sent to a PWM circuit 107 depending on whether a logical value of the dot pattern signal (b) is 1 or 0. Then, in the PWM circuit 107, the density data is converted into a pulse width signal in accordance with a PWM table for generation of a signal with a pulse width corresponding to an image density signal as shown in FIG. 9A to be sent to the laser unit 105. Then, the toner image formed on the photosensitive drum 11*d* becomes an overlapped image in which the dot pattern is formed so as to overlap the normal image as shown in FIG. 3.

Figure 6:
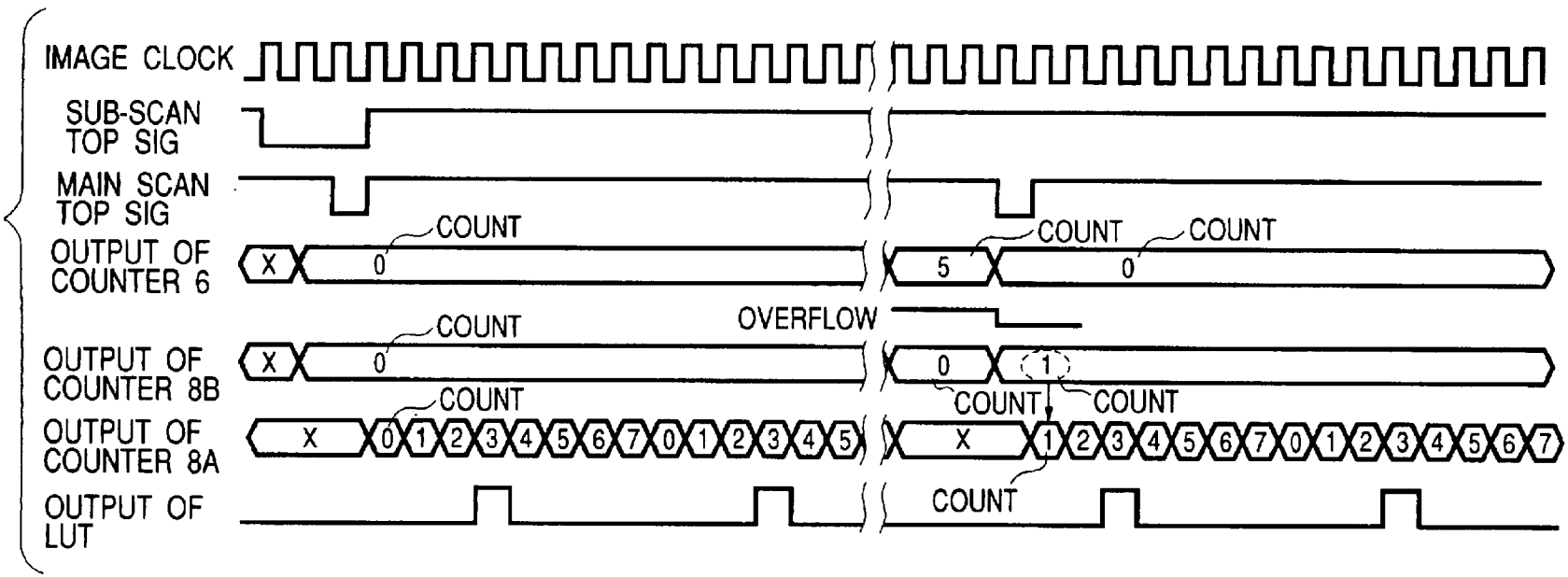
FIG. 6 is a timing chart useful in explaining an example of a method including forming a dot dispersion image according to the present invention.
Figure 7:
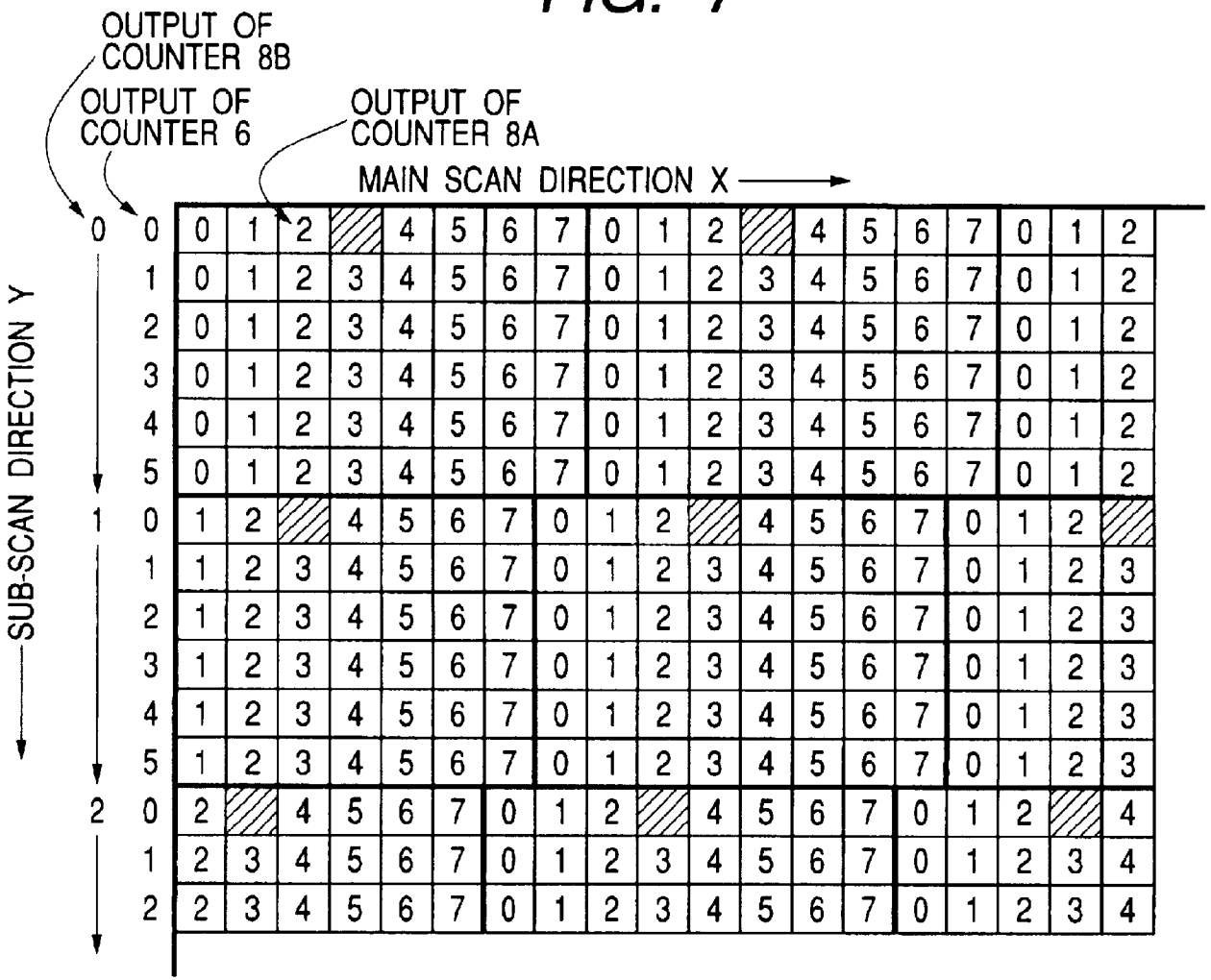
FIG. 7 is a diagram useful in explaining an example of a method including forming a dot dispersion image according to the present invention.

A processing in the dot pattern forming unit 106 in this embodiment will hereinbelow be described with reference to FIGS. 5 and 6. Note that, while in the processing in this embodiment, a dot pattern as shown in FIG. 7 is formed as the dot pattern, this example is merely an example, and hence another dot pattern may be formed in accordance with another method.

Figure 5:
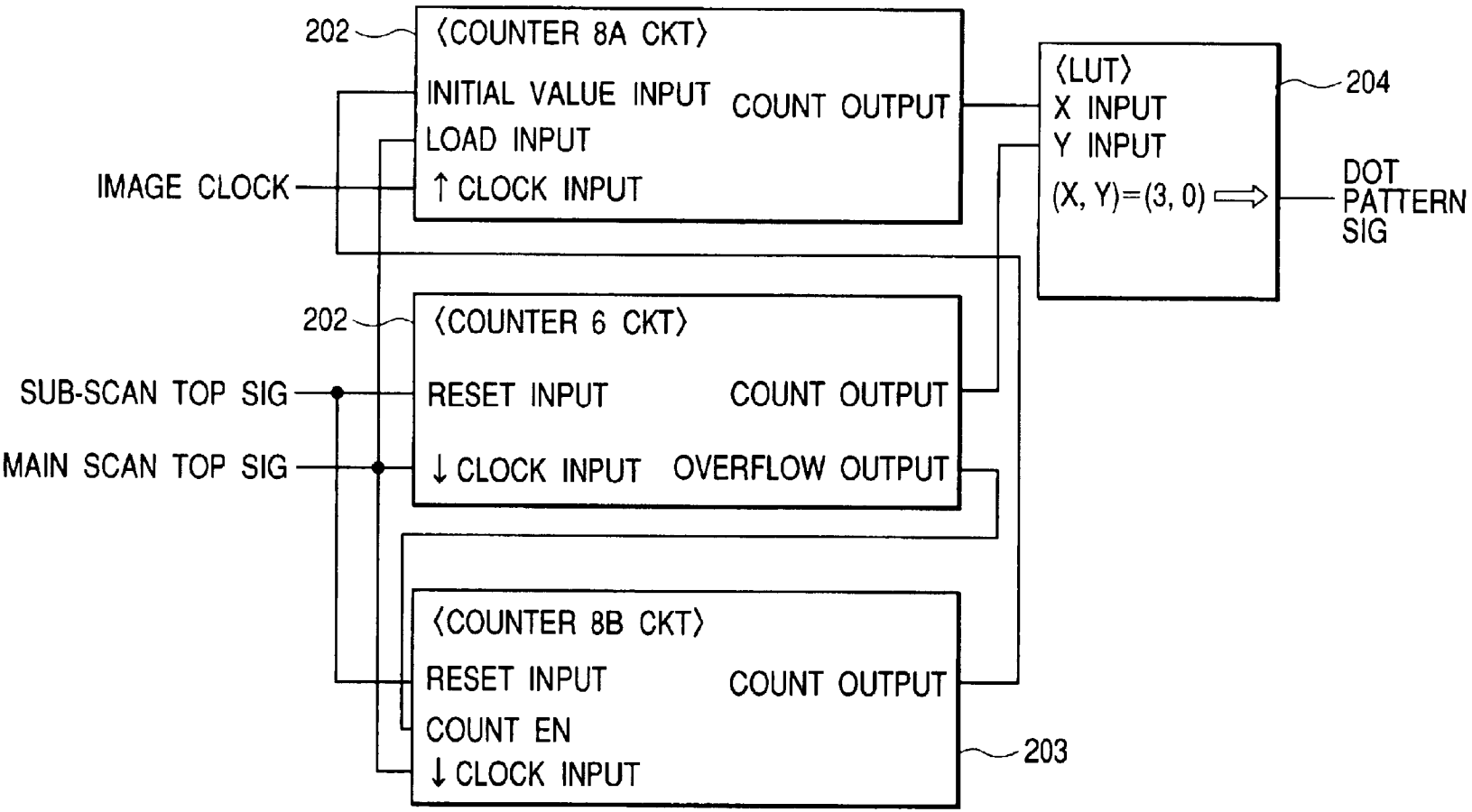
FIG. 5 is a block diagram showing an example of a control circuit for forming a dot dispersion image according to the present invention.

As shown in FIG. 5, the dot pattern forming unit 106 is composed of four circuits composed of a counter 8A circuit 201, a counter 6 circuit 202, a counter 8B circuit 203, and an LUT 204.

As an example, it is assumed that the number, m, of dots of a minute dot area forming the dot pattern in a main scan direction X is 8, and the number, n, of dots in a sub-scan direction Y is 6, and the number, k, of shift dots is 1. In addition, in this embodiment, it is assumed that the number of dots which the dot toner images formed within the dot area have is only 1, and its position is expressed in the form of (main scan direction X, sub-scan direction Y)=(3, 0) within the dot area.

Hence, an operation of the dot pattern forming unit 106 shown in FIG. 6 will hereinbelow be described.

The counter BA circuit 201 counts the position in the main scan direction X by the number, m, of counts=8, and hence repeats counting from 0 to 7 as one partition of the dot area in response to an image clock signal as a clock input signal to divide the additional image formation area in the main scan direction X into dot areas.

Load of an initial value as the number of counts for the position at the leading end of the dot pattern area in the main scan direction becomes possible. Then, a main scan top signal is made a load signal with a value of an output signal of the counter 8B circuit 203 as an initial value. Since an initial value of the counter 8B circuit 203 is 0 in this case, the counter 8A circuit 201 counts as 0 the leading end portion of the dot pattern area in the main scan direction to repeat counting from 0 to 7 until the laser beam reaches the trailing end of the dot pattern area in the main scan direction.

The counter 6 circuit 202 is a counter for counting up taking a main scan top signal as a clock signal, and hence repeats counting from 0 to 5. That is, whenever the counting in the main scan direction by the counter 8A circuit 201 is ended one, the counter 6 circuit 202 counts up by 1. That is, the counter 6 circuit 202 counts the position in the sub-scan direction by the number, n, of counts=6.

The counter 8B circuit 203 is a counter for counting an initial value when the shift is carried out. Then, whenever the counter 6 circuit 202 counts the position in the sub-scan direction from 0 to 5 and the count is returned back to 0 again, i.e., whenever an overflow occurs in the counter 6 circuit 202, the circuit 8B circuit 203 counts up. Then, upon input of the main scan top signal, the counter 8A circuit 202 is loaded with the count value. In other words, after the counter 8A circuit 201 repeatedly counts the position from one end of the dot pattern to the other in the main scan direction by 6, the counter 8B circuit 203 counts up by 1. Then, the number of initial counts obtained when the counter 8A circuit 201 is loaded with the main scan top signal is incremented by 1. Then, if the count initial value is 0, then the number of counts is changed to 1, and then the counting is executed from 1 to 2, 3, 4, . . . in the main scan direction.

A count value of the counter 8A circuit 201 and a count value of the counter 6 circuit are both inputted to the LUT 204. If a combination of the count value of the counter 8A circuit 201 and the count value of the counter 6 circuit agrees with a value set in the LUT 204, then an output signal of the LUT 204 goes to "H" so that a minute dot toner image is formed. In this embodiment, the dot toner image is formed in a position, expressed in the form of (X, Y)=(3, 0), where the counter 8A circuit 201 counts 3 and the counter 6 circuit 202 counts 0.

The dot pattern forming unit 106 is thus operated, with the result that the minute dot pattern is formed as shown in FIG. 7. Each quadrilateral shown in FIG. 7 is a pixel (dot), and the dot toner image of the dot pattern is formed in each pixel indicated by slant lines.

The counter 8A circuit 201 counts the position of the dot pattern in the main scan direction taking as an initial value the count value of the counter 8B circuit 203 obtained whenever the counter 6 circuit 202 counts the position in the sub-scan direction by 6. Hence, as the counting in the sub-scan direction is advanced, the position where the dot toner image is formed at the count of the counter 8A circuit 201=3 is shifted in the main scan direction by the number, k, of shift dots=1.

Whenever six lines in the main scan direction are scanned, the main scan position of the dot toner image is shifted by the number, k, of shift dots=1 in a direction opposite to the main scan direction. Hence, the main scan positions where the dot toner images are respectively formed become uniform. As a result, the image forming apparatus is free from a problem such that longitudinal streak dirt occurs on the secondary transferring roller, the toner collects in a specific position of the cleaning blade, or the dot toner image transferred onto the transferring material is conspicuous.

In this embodiment, the number, k, of shift dots is set to 1. However, in a case where a size, m, of the dot area in the main scan direction is 8 dots, even if such a value that a greatest common divisor between m such as 3, 5 or 7 and k becomes 1 may be adopted as the number, k, of shift dots, it is possible to unify the main scan positions where the dot toner images are respectively formed.

As described above, since the dot pattern thus formed is formed over the whole sheet area shown in FIG. 3 so as to overlap the normal image, there is provided a state where the developer is already present in the nip portion defined between the photosensitive drum 11*d* and the intermediate transferring belt 31 at a timing when the normal image arrives at the transferring portion Ta. As a result, it is possible to provide the image forming apparatus which is capable of carrying out the stabler image formation and printing an image having high quality. With the image forming apparatus, even when there is a difference in peripheral speed between each of the photosensitive drums 11*a* to 11*d* and the intermediate transferring belt 31, a fluctuation in coefficient of friction depending on presence or absence of the toner between each of the photosensitive drums 11*a* to 11*d* and the intermediate transferring belt 31 and a change in rotational speed of each of the photosensitive drums 11*a* to 11*d* are prevented, and generation of an image streak in the leading end portion of the image due to the blurring when images are exposed to the drums 11*a* to 11*d* is avoided. Further, a level of a radiation noise does not increase, and the longitudinal line streak dirt does not occur on the secondary transferring roller 36.

Note that, in this embodiment, when the dot pattern is traced in the sub-scan direction, the position where the dot toner image is formed is shifted in the main scan direction. Hence, the oblique line-like dot pattern shown in FIG. 7 is formed as the whole image. If such a pattern is formed, then an image in which the dots are dotted in a state of being fixed in the main scan direction is difficult to be formed. However, the present invention is not intended to be limited to such a pattern. Hence, a suitable image may be selected as the image which is formed in the form of the dot pattern depending on a kind of normal image and other conditions. In such a case, the method including counting the number of positions in the main scan direction and in the sub-scan direction in the counters, and the positions of the dot toner images in each dot area may be changed, or the dot area may not be partitioned in some cases.

However, in a case where the dot pattern and the normal image are formed so as to overlap each other as described above, the dot toner image may be conspicuous in a white background portion of the normal image, or the dot pattern may appear to generate roughness in the normal image in some cases. The roughness especially remarkably appears when in particular, the dot pattern of a half tone having low density is formed so as to overlap the set-solid image having high density.

Then, in order to solve such inconvenience, the present invention has a feature that the density of the normal image based on the external information is judged every dot in the area where the dot pattern and the normal image are formed so as to overlap each other, and the output density in each dot is adjusted on the basis of the judgement results to thereby suppress the conspicuousness and roughness.

In this embodiment, as described above with reference to FIG. 4, the density discriminating circuit 104 determines whether or not the dot toner images should be formed in the dots in the dot pattern formation area, or determines the density of the dot toner images to be formed.

A processing in the density discriminating circuit 104 shown will hereinbelow be described with reference to a flow chart having Steps S1 to S5 of FIG. 1. In this embodiment, it is assumed that a density value A of an image density signal in each dot is in the range of 256 gradations from 00h to FFh, and a density value B of an added predetermined pattern is C0h.

The predetermined density B is set to density of which a dot pattern is not conspicuous so much even when the dot pattern is formed in a white background portion of the normal image. The dot pattern becomes better as the density becomes lower in terms of conspicuousness. However, since the electrostatic latent image is shallower in the case of low density, in a case as well where dots are formed with the same density, an amount of toner actually dotted disperses due to a difference among machines, and hence the expanded effects may not be obtained in such cases. Thus, in the case of a machine construction capable of providing excellent dot rendering, the value equal to or larger than an intermediate value (40h) is selected as the density, while in the case of a machine construction unable to provide excellent dot rendering, the value equal to or larger than 80h is used as the density.

In Step S1: The image density signal (a) and the dot pattern signal (b) (refer to FIG. 4) are inputted to the density discriminating circuit 104 every input of an image clock signal.

In Step S2: It is judged in Step S1 whether or not a logical value of the dot pattern signal (b) inputted to the density discriminating circuit 104 is 1. If it is judged that the logical value is 1, then the dot concerned is judged to be the dot with which the dot toner image is to be added.

In Step S3: If the judgement result in Step S2 is YES, then it is judged whether or not the normal image density value A based on the image density signal (a) is larger than the predetermined value B=C0h.

In Step S5: If it is judged in Step S3 that the normal image density value A is equal to or smaller than the predetermined value B=C0h, the density concerned is lighter than the density set in the dot pattern, so that the density discriminating circuit 104 outputs a signal corresponding to C0h as the predetermined density value B to the PWM circuit 107.

In Step S4: If the judgement result in Step S2 is NO, i.e., if a logical value of the dot pattern signal (b) is 0, the dot concerned is not the dot with which the dot pattern is to be added, so that the density discriminating circuit 104 outputs a signal corresponding to the normal density value A from the image density signal (a) to the PWM circuit 107 as it is. In addition, in a case as well where it is judged in Step S3 that the normal image density value A is larger than the predetermined density value B=C0h, in order to make the image rendering excellent, the density discriminating unit outputs a signal corresponding to the normal density value A based on the image density signal (a) to the PWM circuit 107 as it is.

Figure 1:
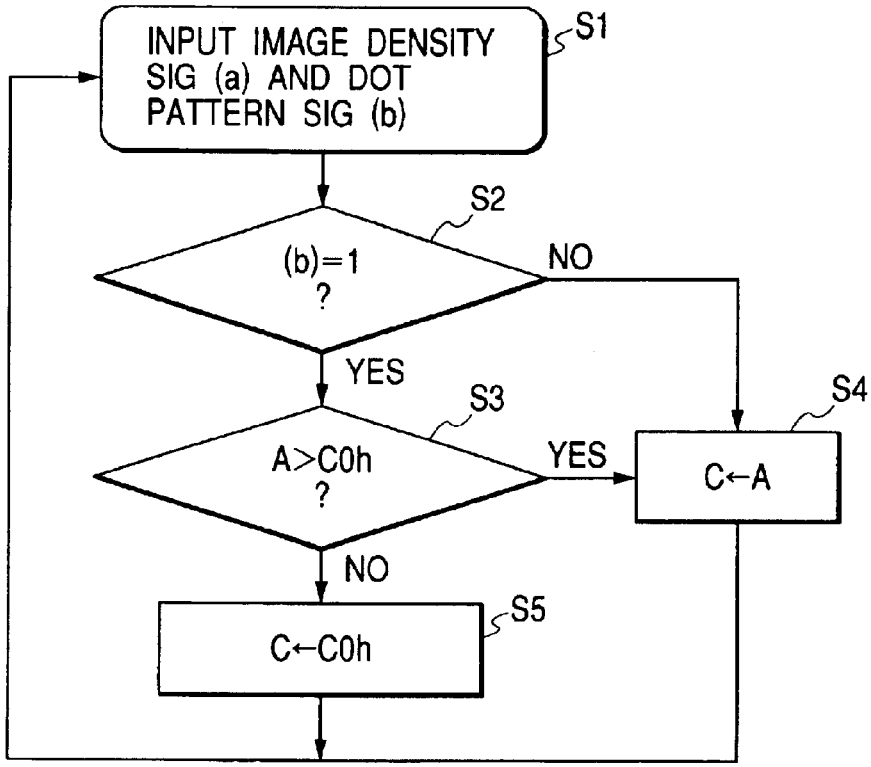
FIG. 1 is a flow chart showing a method including determining density of a dot developer image according to the present invention.

If as an example, the output density C is judged in accordance with the flow chart shown in FIG. 1 with respect to four kinds of combinations of the normal image density A and the input value b based on the dot pattern signal (b) which is composed of (80h, 0), (80h, 1), (E0h, 0), and (E0h, 1) to express such a combination in the form of (A, b)→the output density value C, the following results are obtained:

(80h, 0)→80h (80h, 1)→C0h (E0h, 0)→E0h (E0h, 1)→E0h

Thus, in the formation of the dot pattern, the dot toner image is added with C0h as the predetermined density to a portion in which the density of the normal image of the dot portion in the dot pattern to which the dot toner image is added is lighter than the predetermined density C0h. On the other hand, when the density of that portion is darker than the predetermined density C0h, the image is formed with the normal image density while the density information based on the image signal is kept as it is. That is, when the density of the normal image is darker than the predetermined density, in this one dot, the developer of yellow is used on the photosensitive drum 11*d* so that its density agrees with the density of the normal image.

For that reason, the dot toner image is not formed in a portion having light density in the normal image in a state where the density of the dot toner image is darker than the predetermined density, and hence is hardly conspicuous even if the dot toner image is formed so as to overlap a white background portion of the normal image. Moreover, since the dot pattern having density lighter than that of the normal image is not formed so as to overlap a portion having dark density in the normal image, the dot pattern is not enhanced in the normal image, and hence no roughness or the like occurs in the image.

Second Embodiment

Figure 8:
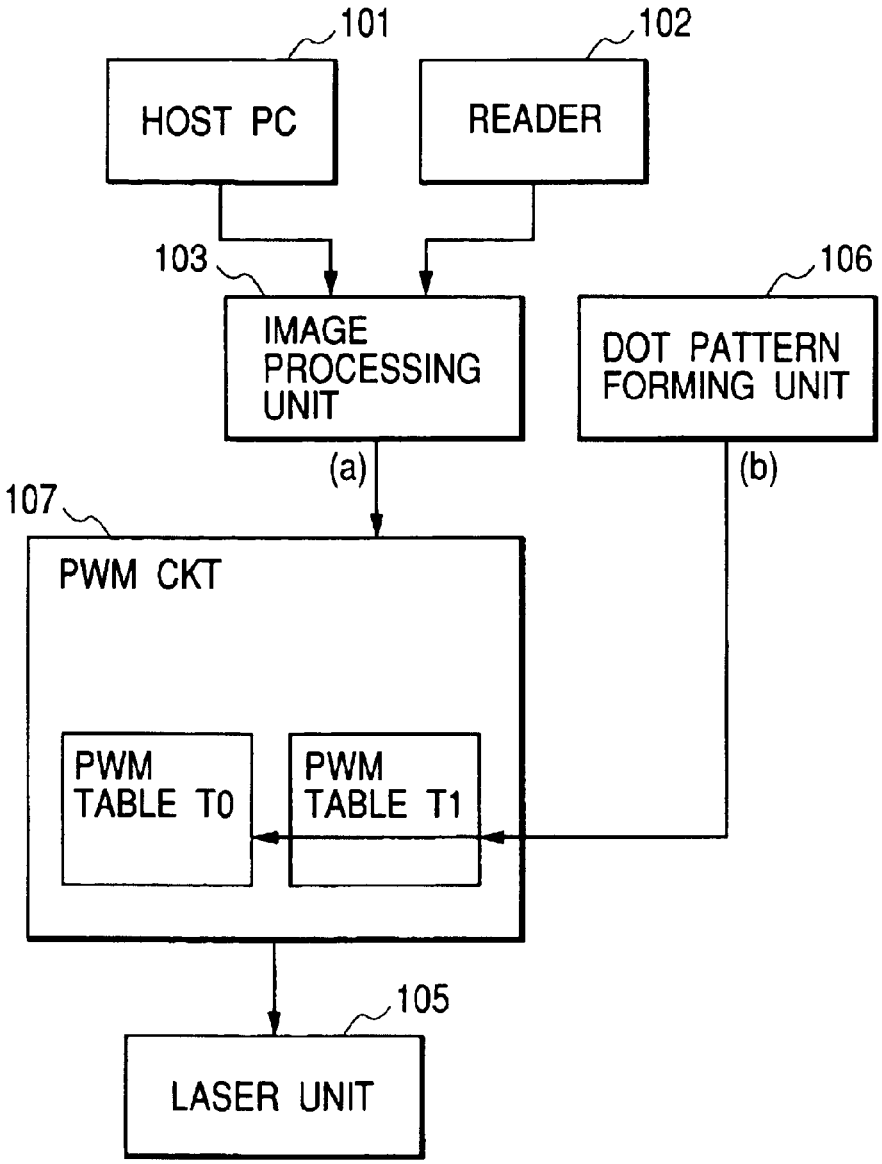
FIG. 8 is a block diagram showing another example of a control circuit for determining density of a dot developer image according to the present invention.

Next, a second embodiment will hereinbelow be described. A difference from the first embodiment lies in a method including generating the PWM signal inputted to the laser unit 105. FIG. 8 is a block diagram showing a construction of this embodiment.

The image density signal (a) generated in the image processing unit 103, and the dot pattern signal (b) generated in the dot pattern forming unit 106 are directly inputted to the PWM circuit 107.

Two PWM tables are prepared within the PWM circuit 107, and the dot pattern signal (b) inputted to the PWM circuit 107 is used to select between the two tables. That is, when a logical value of the dot pattern signal (b) is 0, a PWM table T0 is used, while when a logical value of the dot pattern signal (b) is 1, a PWM table T1 is used.

Figure 9B:
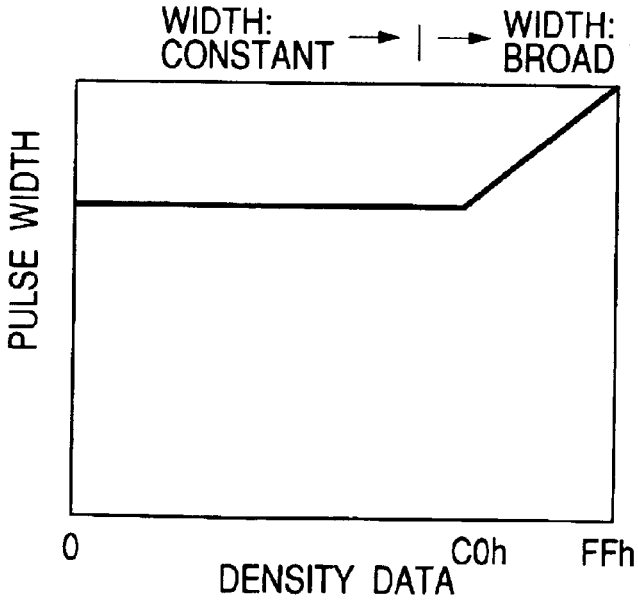

The PWM tables T0 and T1 which are adopted in this embodiment are shown in FIGS. 9A and 9B, respectively.

As shown in FIG. 9A, the PWM table T0 is a table for generation of a signal corresponding to a pulse width which increases in proportion to the level of the image density signal. Then, when the image density A based on the image density signal (a) is 00h, the pulse width becomes 0, while when the density A of the normal image is FFh, full lighting data corresponding to the maximum pulse width is generated.

On the other hand, as shown in FIG. 9B, in accordance with the PWM table T1, when the density A of the normal image is equal to or lighter than that indicated by C0h, a signal having a constant pulse width corresponding to C0h of the PWM table T0 is generated, while the density A of the normal image is darker than that indicated by C0h, a signal having a pulse width which increases in proportion to the density A of the normal image is generated.

As a result, the pulse width signal similar to that in the circuit of the first embodiment is obtained. Thus, the dot toner image is formed with the predetermined density B=C0h so as to overlap a portion in which the density indicated by the image density signal is lighter than the density indicated by the predetermined value B, while when the density indicated by the image density signal is darker than the density indicated by the predetermined value B, the dot toner image is formed using the image density signal directly. Hence, no conspicuousness, roughness or the like of the dot toner image occurs in the image.

Note that, in this embodiment, the dot dispersion image is formed over the whole area of the transferring material area. However, the dot dispersion image may not be formed over the whole area of the transferring material area, and hence may be formed in a portion on an upstream side in the travel direction of the intermediate transferring belt with respect to the image formation area as well as in an area overlapping the normal image area within the transferring material area. Thus, the present invention is applied to a portion of the dot toner image overlying the normal image.

As described above, in this embodiment, the present invention has been described with respect to the color image forming apparatus which has such a construction as to have a plurality of photosensitive drums and which is adapted to form an image with a plurality of colors. However, the image forming apparatus is not limited to the above construction. Hence, the present invention may also be applied to a single color image forming apparatus, or an image forming apparatus having one photosensitive drum.

For example, appearance of the image streak due to a change in frictional force is not limited to only the operation for forming a color image. Thus, for example, in a case where an image with single color of black is formed using a color copying machine, or even in a monochrome copying machine, light and shade image streaks appear due to a change in frictional force. Hence, there is a need to form dot toner images of black. In this case as well, the present invention is applied to realize the image forming apparatus which is capable of preventing dot toner images from being conspicuous, and also capable of preventing image quality from being degraded due to roughness or the like.

Figure 12:
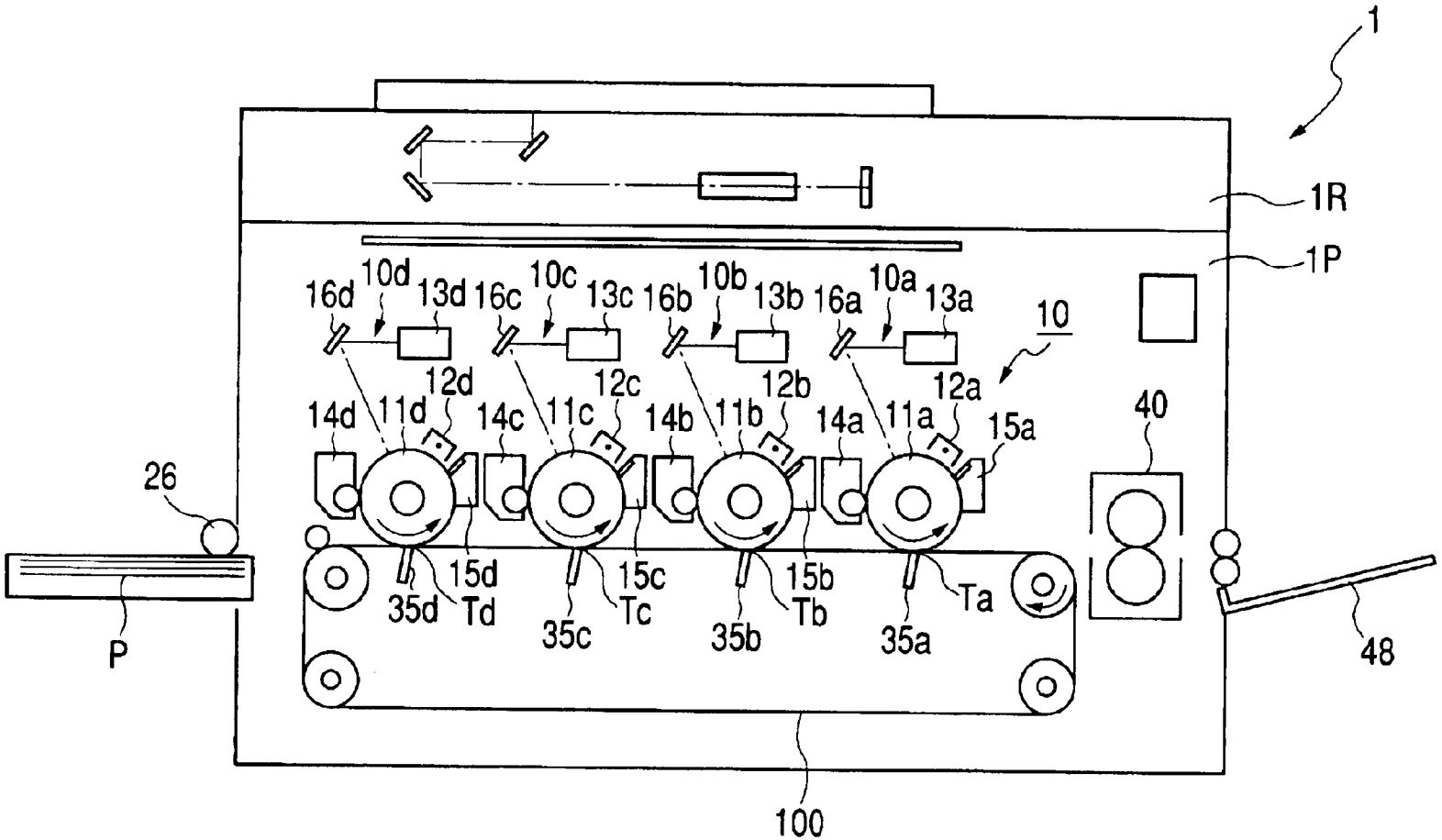
FIG. 12 is a cross sectional view showing an example of another image forming apparatus according to the present invention.

In addition, the present invention may be applied to an image forming apparatus using no intermediate transferring body, e.g., a system as well, as shown in FIG. 12, for directly transferring a developer image from an image bearing body onto a transferring material (recording material) with which a transferring material conveying body (transferring medium) or the like is loaded. In this example, a peripheral speed difference is provided in many cases between a travel speed of the transferring material carrying body and a travel speed of the image bearing body.

In FIG. 12, the same constituent elements as those of FIG. 10 are designated with the same reference numerals. In this image forming apparatus, the recording material P accommodated in the cassette is fed by the sheet feeding roller 26 to be carried and conveyed by a conveying belt 100 which is stretched across a plurality of rollers. Images formed in the respective image forming units are successively transferred onto the recording material P being carried and conveyed, and thereafter the fixing operation is carried out for the recording material P by the fixing unit 40. The formation of the dot image as described above in the first embodiment is carried out in this image forming apparatus as well, whereby the same effects can be produced.

In addition, even with a construction in which no peripheral speed difference is provided between the image bearing body and the transferring movement unit, a non-intentional speed difference may be generated due to the decentering or the like of the drive roller in some cases, so that the present invention can be applied to such a construction.

Also, the scope of the present invention is not intended to be limited to only the sizes, materials, shapes, the relative positions and the like of the constituent elements of the image forming apparatus described above, as long as a specific description of those factors is not especially made.

What is claimed is:

1. An image forming apparatus, comprising:

a movable image bearing body;

image forming means for forming a developer image on the image bearing body;

transferring means for transferring the developer image formed on the image bearing body onto a moving transferring medium; and control means for controlling the image forming means to form a predetermined image composed of dot images with a predetermined density prior to formation of a normal image, wherein the control means controls the image forming means so as to:

form a composite image from the normal image and the predetermined image in an area where the normal image is to be formed; and form the dot images in a dot area having the normal image and the predetermined image overlapped with each other, with a density determined on the basis of a relationship between a density of the normal image and the predetermined density in the dot area.

2. An image forming apparatus according to claim 1, wherein when the density of the normal image is equal to or lighter than the predetermined density in the dot area having the normal image and the predetermined image overlapped with each other, the dot image is formed with the predetermined density, and when the density of the normal image is darker than the predetermined density in the dot area having the normal image and the predetermined image overlapped with each other, the dot image is formed with the density of the normal image.

3. An image forming apparatus according to claim 1, wherein the transferring medium is a recording material, and the control means controls the image forming means so as to form the predetermined image within an area corresponding to the recording material.

4. An image forming apparatus according to claim 1, wherein the transferring medium is a recording material carrying body for carrying and conveying a recording material, the transferring means serves to transfer the developer image onto the recording material, and the control means controls the image forming means so as to form the predetermined image within an area corresponding to the recording material.

5. An image forming apparatus according to claim 1, wherein the transferring medium is an intermediate transferring body for transferring the developer image temporarily transferred onto the intermediate transferring body onto a recording material, and the control means controls the image forming means so as to form the predetermined image within an area corresponding to the recording material.

6. An image forming apparatus according to claim 1, wherein a travel speed of a surface of the image bearing body is difficult from a travel speed of a surface of the transferring medium.

7. An image forming apparatus according to claim 1, wherein when an operation for continuously forming a plurality of normal images is carried out, the control means controls the image forming means so as to continuously carry out the formation of the predetermined image for a period of time ranging from a time point before the formation of a first normal image up to a time point of completion of the formation of a final normal image.

8. An image forming apparatus according to claim 1, wherein the control means controls the image forming means so as to form the predetermined image in the form of an image obtained by uniformly dispersing dot images each having an area in units of one or a plurality of dots.

9. An image forming apparatus according to claim 8, wherein when the dot image is formed in predetermined positions within a dot area having m dots in a direction intersecting perpendicularly to an image movement direction and n dots in the image movement direction (m, n: integer), the control means controls the image forming means so as to:

set the positions of the dot images within the dot areas in the direction intersecting perpendicularly to the image movement direction to be identical to one another; and successively shift the positions of the dot images within the dot areas in the image movement direction by k dots in the direction intersecting perpendicularly to the image movement direction (k: integer).

10. An image forming apparatus according to claim 9, wherein a greatest common divisor between m and k is 1.

11. An image forming apparatus according to claim 1, further comprising a plurality of image forming means, wherein the developer images formed by the plurality of image forming means are successively transferred onto the transferring medium, and the control means controls the image forming means so as to form the predetermined image only in the image forming means for forming the developer image to be firstly transferred onto the transferring medium.

12. An image forming apparatus according to claim 11, wherein the image forming means for forming the predetermined image forms the developer image of a yellow color.

13. An image forming apparatus according to claim 1 or 2, wherein the predetermined density is lighter than the maximum density with which the image forming means can form the developer image in the dot area.

* * * * *

UNITED STATES PATENT AND TRADEMARK OFFICE

CERTIFICATE OF CORRECTION

PATENT NO. : 6,944,418 B2
DATED : September 13, 2005
INVENTOR(S) : Tomohiro Tamaoki It is certified that error appears in the above-identified patent and that said Letters Patent is hereby corrected as shown below:

Column 2,
Line 51, “a” should be deleted.

Column 4,
Lines 1 and 14, “cross sectional” should read -- cross-sectional --.

Column 6,
Line 29, “at” should be deleted.

Column 7,
Line 1, “an” should read -- a --.

Column 17,
Line 1, “difficult” should read -- different --.

Signed and Sealed this

Third Day of January, 2006

JON W. DUDAS
*Director of the United States Patent and Trademark Office*

UNITED STATES PATENT AND TRADEMARK OFFICE

CERTIFICATE OF CORRECTION

PATENT NO. : 6,944,418 B2
APPLICATION NO. : 10/694862
DATED : September 13, 2005
INVENTOR(S) : Tamaoki It is certified that error appears in the above-identified patent and that said Letters Patent is hereby corrected as shown below:

On the Title page, Item {*] Notice: "Subject to any disclaimer, the term of this patent is extended or adjusted under 35 USC 154(b) by (70) days" should read --Subject to any disclaimer, the term of this patent is extended or adjusted under 35 USC 154(b) by (67) days--.

Signed and Sealed this

Twenty-second Day of May, 2007

JON W. DUDAS
*Director of the United States Patent and Trademark Office*